US006841047B2

(12) United States Patent
Gestermann et al.

(10) Patent No.: US 6,841,047 B2
(45) Date of Patent: Jan. 11, 2005

(54) ELECTROLYSIS CELL, IN PARTICULAR FOR THE ELECTROCHEMICAL PREPARATION OF CHLORINE

(75) Inventors: Fritz Gestermann, Leverkusen (DE); Hans-Dieter Pinter, Wermelskirchen (DE); Andreas Bulan, Langenfeld (DE); Walter Klesper, Bergisch Gladbach (DE)

(73) Assignee: Bayer Aktiengesellschaft, Leverkusen (DE)

( * ) Notice: Subject to any disclaimer, the term of this patent is extended or adjusted under 35 U.S.C. 154(b) by 191 days.

(21) Appl. No.: 10/214,480

(22) Filed: Aug. 2, 2002

(65) Prior Publication Data

US 2003/0047446 A1 Mar. 13, 2003

(30) Foreign Application Priority Data

Aug. 3, 2001 (DE) ..... 101 38 214

(51) Int. Cl.[7] ..... C25B 9/00; C25B 11/00

(52) U.S. Cl. ..... 204/252; 204/288.3; 204/297.14; 204/282

(58) Field of Search ..... 204/265–266, 204/282–283, 252, 297.14, 279, 288.3

(56) References Cited

U.S. PATENT DOCUMENTS 4,341,604 A * 7/1982 DeNora et al. ..... 205/525
4,617,101 A * 10/1986 Sato et al. ..... 204/252
4,639,303 A 1/1987 Staab et al. ..... 204/258
4,732,660 A 3/1988 Plowman et al. ..... 204/265
5,770,035 A 6/1998 Faita ..... 205/624

OTHER PUBLICATIONS

Patent Abstracts Of Japan, vol. 2000, No. 11, Jan. 3, 2001 & JP 2000 226681 A (Furuya Choichi;Toagosei Co Ltd; Mitsui Chemicals Inc; Kanegafuchi Chem), Aug. 15, 2000 Zusammenfassung.

* cited by examiner

*Primary Examiner*—Donald R. Valetine
(74) *Attorney, Agent, or Firm*—Joseph C. Gil; Lyndanne M. Whalen

(57) ABSTRACT

The invention relates to an electrolysis cell comprising an anode frame (26), an anode (24), a cation-exchange membrane (34), a gas diffusion electrode (32), a current collector (10) and a cathode frame (12), with the anode (24), the cation-exchange membrane (34), the gas diffusion electrode (32) and the current collector (10) being held together elastically so that there is no gap between the individual components anode (24), cation-exchange membrane (34), gas diffusion electrode (32) and current collector (10). The elastic cohesion is preferably achieved by the current collector (10) being elastically fastened to the cathode frame (12) and/or the anode (24) being elastically fastened to the anode frame (26).

8 Claims, 4 Drawing Sheets

ELECTROLYSIS CELL, IN PARTICULAR FOR THE ELECTROCHEMICAL PREPARATION OF CHLORINE

Figure 1:
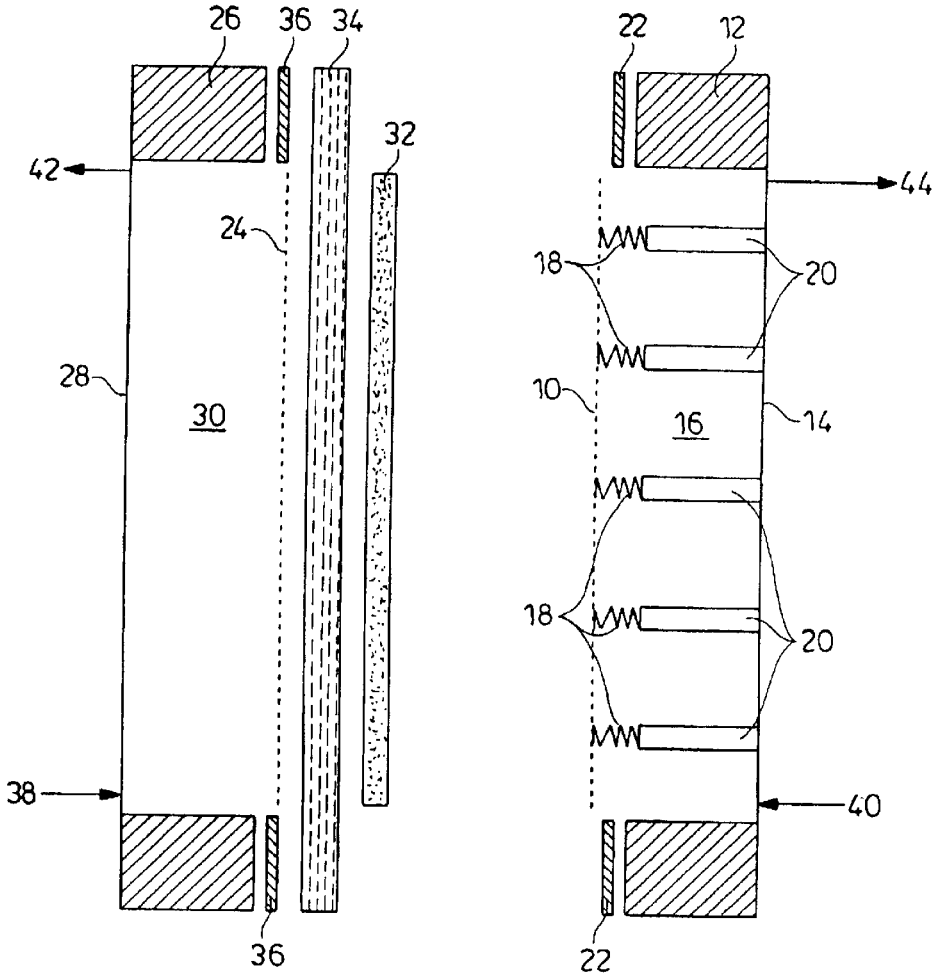

The invention relates to an electrolysis cell which is suitable, in particular, for the electrochemical preparation of chlorine from aqueous solutions of hydrogen chloride.

Aqueous solutions of hydrogen chloride, hereinafter referred to as hydrochloric acid, are obtained as by-product from many processes, in particular those in which organic hydrocarbon compounds are oxidatively chlorinated by means of chlorine. The recovery of chlorine from these hydrochloric acids, so that it can then be used, for example, for further chlorinations, is an economically interesting subject. Chlorine can, for example, be recovered electrolytically from hydrochloric acids.

U.S. Pat. No. 5,770,035 discloses the electrolysis of hydrochloric acid to give chlorine in an electrolysis cell. An anode chamber provided with a suitable anode, e.g. a titanium electrode coated or doped with noble metal, is filled with the aqueous solution of hydrogen chloride. The chlorine formed at the anode leaves the anode chamber and is passed to a suitable work-up. The anode chamber is separated from a cathode chamber by a commercial cation-exchange membrane. On the cathode side, a gas diffusion electrode is in contact with the cation-exchange membrane. A current distributor is located behind the gas diffusion electrode. Gas diffusion electrodes are, for example, oxygen-consuming cathodes (OCCs). In the case of an OCC as gas diffusion electrode, an oxygen-containing gas or pure oxygen is usually passed into the cathode chamber and reacted at the OCC.

In the electrolysis cell described in U.S. Pat. No. 5,770,035, the anode chamber has to be maintained at a higher pressure than the cathode chamber. As a result, the cation-exchange membrane is pressed onto the gas diffusion electrode and this in turn is pressed onto the current distributor. The pressure can be generated, for example, by the tube through which the chlorine gas formed in the anode chamber is conveyed dipping into a liquid.

A high oxygen pressure in the cathode chamber is advantageous because it leads to a lower voltage and thus to decreased energy consumption. However, the electrolysis cell known from U.S. Pat. No. 5,770,035 has the disadvantage that the pressure in the cathode chamber, i.e. the oxygen pressure, can be increased only when the pressure in the anode chamber is increased simultaneously, since otherwise the gas diffusion electrode is pushed away from the current collector and is no longer in contact with it. A simultaneous increase in the pressure in the anode chamber can be achieved industrially only by means of costly structural alterations to the electrolyser. Increasing the pressure only in the anode chamber can, in the case of the known cell design, lead to the gap between anode and cation-exchange membrane being increased, which leads to an undesirable increase in the operating voltage and thus to increased energy consumption.

It is an object of the invention to provide an electrolysis cell, in particular for the electrochemical preparation of chlorine from aqueous solutions of hydrogen chloride, in which it is ensured that the anode, the cation-exchange membrane, the gas diffusion electrode and the current collector are in direct contact with one another even in the case of a pressure difference between anode chamber and cathode chamber.

This object is achieved according to the invention by the features of claim 1.

The electrolysis cell of the invention has an anode and a current collector which are supported by an anode frame and a cathode frame, respectively. A cation-exchange membrane is located between the anode and the current collector and a gas diffusion electrode is located between cation-exchange membrane and current collector. To avoid occurrence of a gap between these components even in the case of, for example, pressure differences between the anode side and the cathode side, the anode and/or the current collector are/is, according to the invention, elastically connected to the anode frame or the cathode frame. Owing to the elastic connection, a force is applied to the anode and/or the current collector, so that the anode is pushed in the direction of the current collector and/or the current collector is pushed in the direction of the anode. In this way, the anode, the cation-exchange membrane, the gas diffusion electrode and the current collector are held together so that no gap or intermediate space can occur between these. As a result, an undesirable increase in the operating voltage is avoided.

The anode and/or the current collector are preferably held elastically by pressure forces acting on the anode and/or the current collector. It is likewise possible for the anode and/or the current collector to be connected to the anode frame or cathode frame in such a way that tensile forces which are in each case directed in the direction of the other electrode act on the anode or the current collector.

To hold the anode and/or the current collector elastically, the anode frame or cathode frame can have an elastic construction or be provided with an elastic element. Preference is given to at least one elastic holding element, for example a spring, which is joined to the anode frame or the cathode frame being provided. Particular preference is given to providing a plurality of holding elements which are, in particular, arranged in a regular fashion. The holding elements are preferably arranged and/or configured in such a way that an essentially uniform pressure is applied to the anode and/or the current collector. The force per unit area is thus essentially equal at all points on the anode or the current collector in the case of essentially flat anodes or current collectors.

The holding elements are preferably configured as spring elements which can be, for example, leaf or helical springs. The holding elements are preferably either connected directly to the frame or connected via a back wall of the anode or cathode chamber to the corresponding frame.

The size of the anode and/or the current collector is preferably selected so that it can be located within the frame and does not rest against or on the frame. The anode and/or the current collector are/is thus held solely by the holding element or elements.

In a particularly preferred embodiment, electrical contact to the anode and/or to the current collector is likewise established via the holding elements. An additional electrical connection to anode and/or current collector can thus be omitted in this preferred embodiment. The elastic fixing of anode and/or current collector can be achieved, for example, by means of springs or other electrically conductive, elastic connections such as carbon felts or metal sponges. The elastic fixing is preferably achieved by means of metallic springs. For example, springs of titanium or titanium alloys are used as holding elements since these are not damaged by the chemical substances present in the electrolysis cell. To improve the electrical conductivity of the titanium springs, it is also possible to use, for example, copper springs which are sheathed with titanium.

In all the above-described preferred embodiments, it is sufficient for the required compressive forces to be present in the assembled state of the electrolysis cell.

The cell construction according to the invention ensures that the anode is in direct contact with the cation-exchange membrane, that the latter is in direct contact with the gas diffusion electrode and that this is in turn in direct contact with the current collector, i.e. that there is no gap between the components mentioned. This is also reliably the case when the electrolysis cell is operated in such a way that different pressures prevail in the anode chamber and in the cathode chamber.

The anode frame and the cathode frame are preferably also made of resistant materials, e.g. titanium or titanium alloys coated or doped with noble metals.

Preference is given to using gas diffusion electrodes which contain a catalyst of the platinum metal group, preferably platinum or rhodium. Mention may be made by way of example of gas diffusion electrodes from E-TEK (USA) which contain 30% by weight of platinum on activated carbon and have 1.2 mg of $Pt/cm^2$ of electrode.

Suitable cation-exchange membranes are, for example, membranes made of perfluoroethylene and containing sulphonic acid groups as active centres. For example, it is possible to use commercial membranes from DuPont, for instance the membrane Nafion® 324. Both single-layer membranes which have sulphonic acid groups having identical equivalent weights on both sides and membranes which have sulphonic acid groups having different equivalent weights on the two sides. Membranes having carboxyl groups on the cathode side are likewise conceivable.

Suitable anodes are, for example, titanium anodes, in particular those having an acid-resistant, chlorine-producing coating, e.g. as based on ruthenium-coated titanium.

The cathode-side current distributor can be made, for example, of titanium expanded metal or titanium coated with noble metal, but alternative, resistant materials can also be used.

The electrolysis cell of the invention is suitable, in particular, for the electrochemical preparation of chlorine from aqueous solutions of hydrogen chloride or aqueous solutions of an alkali metal chloride, in particular sodium chloride.

When the electrolysis cell is being used, the pressure in the cathode chamber is preferably greater than that in the anode chamber if the current collector is held elastically. In this case, the differential pressure between anode chamber and cathode chamber can be, for example, in the range from 0.01 to 1 bar, but greater differential pressures are also possible. The differential pressure is preferably from 20 to 350 mbar.

If the anode is held elastically, it is advantageous for the pressure in the anode chamber to be greater than that in the cathode chamber.

In the following, a process for preparing chlorine which can be carried out using the electrolysis cell of the invention is described in greater detail for, by way of example, the reaction of aqueous solutions of hydrogen chloride. The reaction of alkali metal chlorides, in particular sodium chloride, which is likewise possible, can be carried out in a similar manner with process conditions being varied if necessary.

To carry out the process, an oxygen-containing gas, for example pure oxygen, a mixture of oxygen and inert gases, in particular nitrogen, or air, preferably oxygen or an oxygen-rich gas, is passed into the cathode chamber.

The oxygen-containing gas used is particularly preferably pure oxygen, in particular oxygen having a purity of at least 99% by volume.

The oxygen-containing gas is preferably fed in in such an amount that oxygen is present in a superstoichiometric amount based on the amount which is theoretically required according to equation (1). The stoichiometric excess is preferably from 1.1 to 3 times, more preferably from 1.2 to 1.5 times, the stoichiometric amount. The excess oxygen can be recycled, so that the stoichiometric excess is of only subordinate importance.

$$\begin{aligned} &\text{Anode reaction:} && 4\,HCl \rightarrow 2\,Cl_2 + 4\,H^+ + 4\,e^- \\ &\text{Cathode reaction:} && O_2 + 4\,H^+ + 4\,e^- \rightarrow 2\,H_2O \\ \hline &\text{Overall reaction:} && 4\,HCl + O_2 \rightarrow 2\,Cl_2 + 2\,H_2O \end{aligned} \tag{1}$$

The aqueous solution of the hydrogen chloride is fed into the anode chamber. The temperature of the aqueous solution of hydrogen chloride introduced is preferably from 30 to 80° C., particularly preferably from 50 to 70° C.

Preference is given to using aqueous solutions of hydrogen chloride having a hydrogen chloride concentration of from 5 to 20% by weight, particularly preferably from 10 to 15% by weight.

Regardless of the electrolysis cell according to the invention which is chosen, the electrolysis is preferably carried out at a pressure in the anode chamber of greater than 1 bar absolute.

The pressure in the cathode chamber is preferably greater than 1 bar absolute, particularly preferably from 1.02 to 1.5 bar, very particularly preferably from 1.05 to 1.3 bar. It has been found that, for a given current density, the electrolysis can be carried out at a lower voltage, i.e. with lower energy consumption, at a higher pressure in the cathode chamber, i.e. a higher oxygen pressure.

The pressure in the cathode chamber can be set, for example, by banking up the oxygen-containing gas fed into the cathode chamber by means of a pressure maintenance device. An example of a suitable pressure maintenance device is a tube dipping into a liquid by means of which the cathode chamber is closed off. Restriction of the flow by means of valves is likewise a suitable method of setting the pressure.

Figure 2:
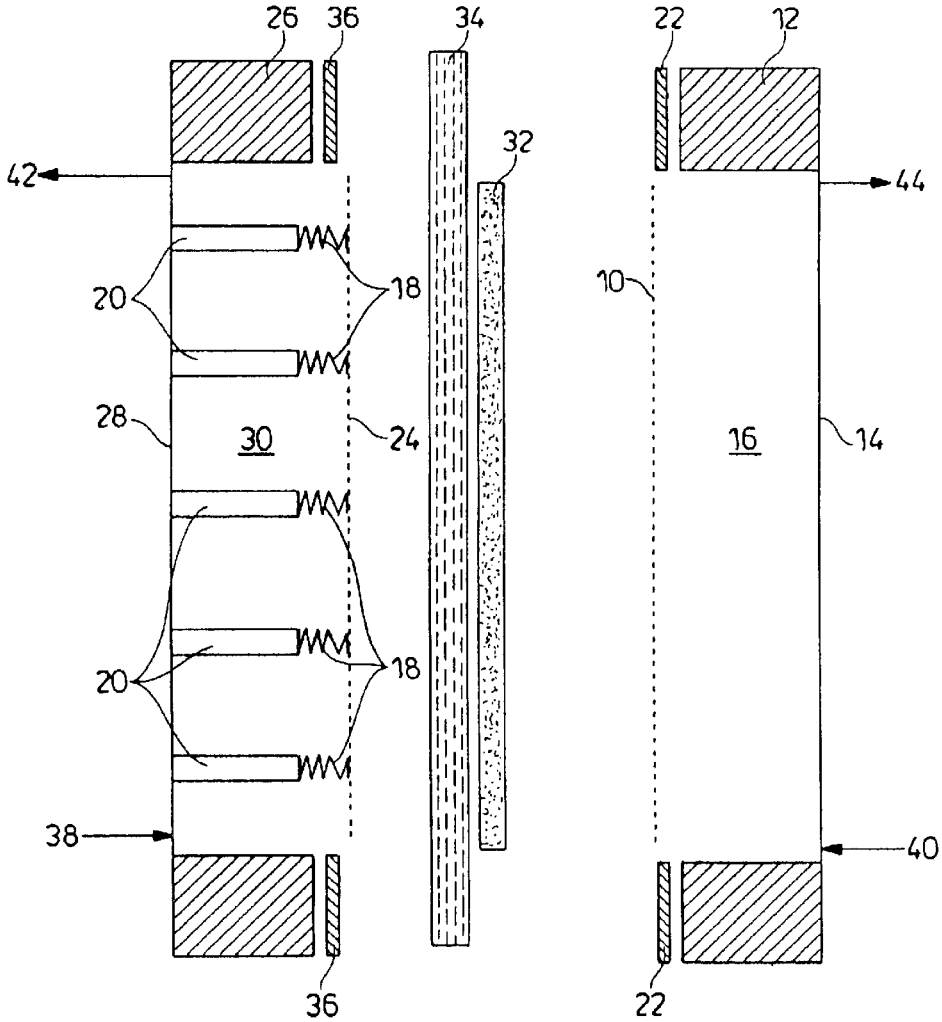
Figure 3:
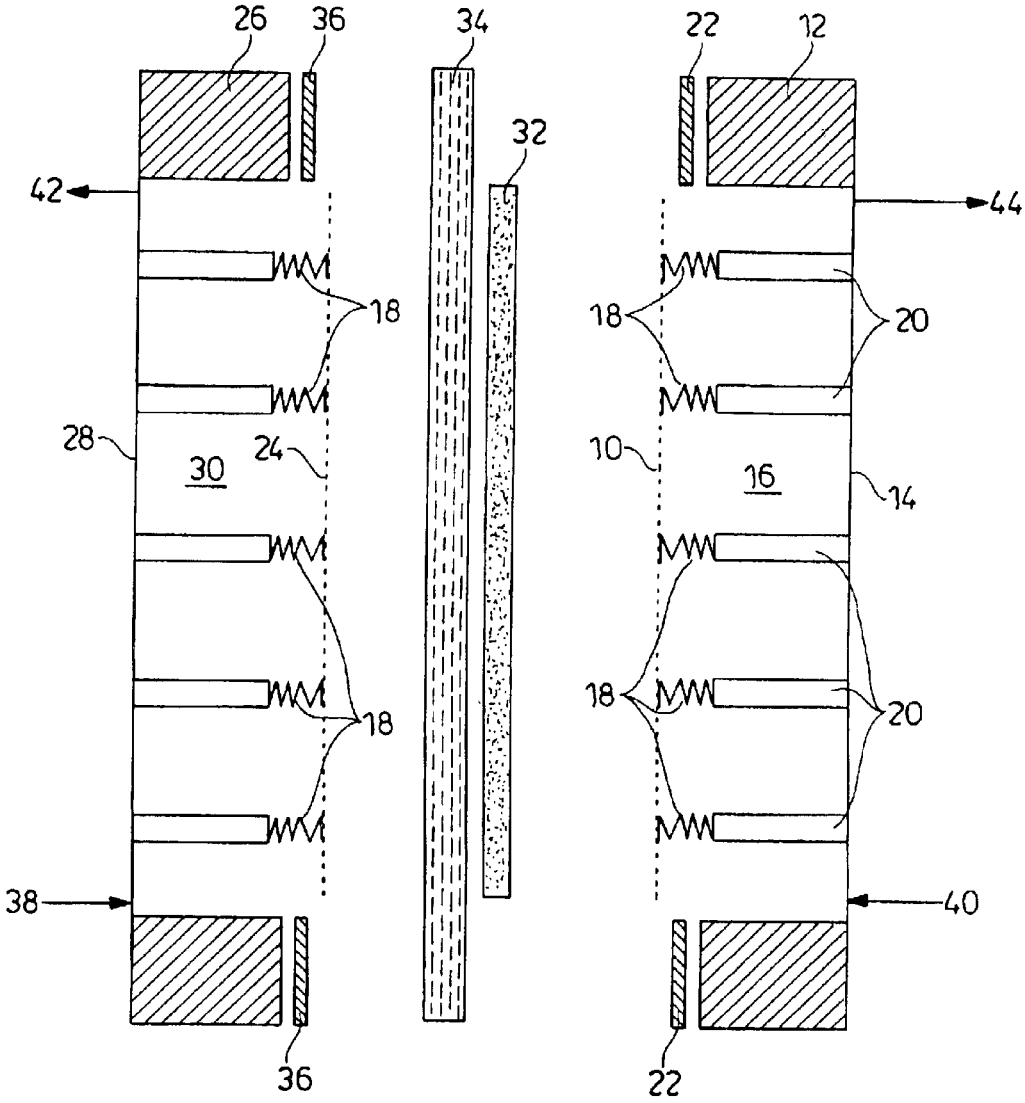
Figure 4:
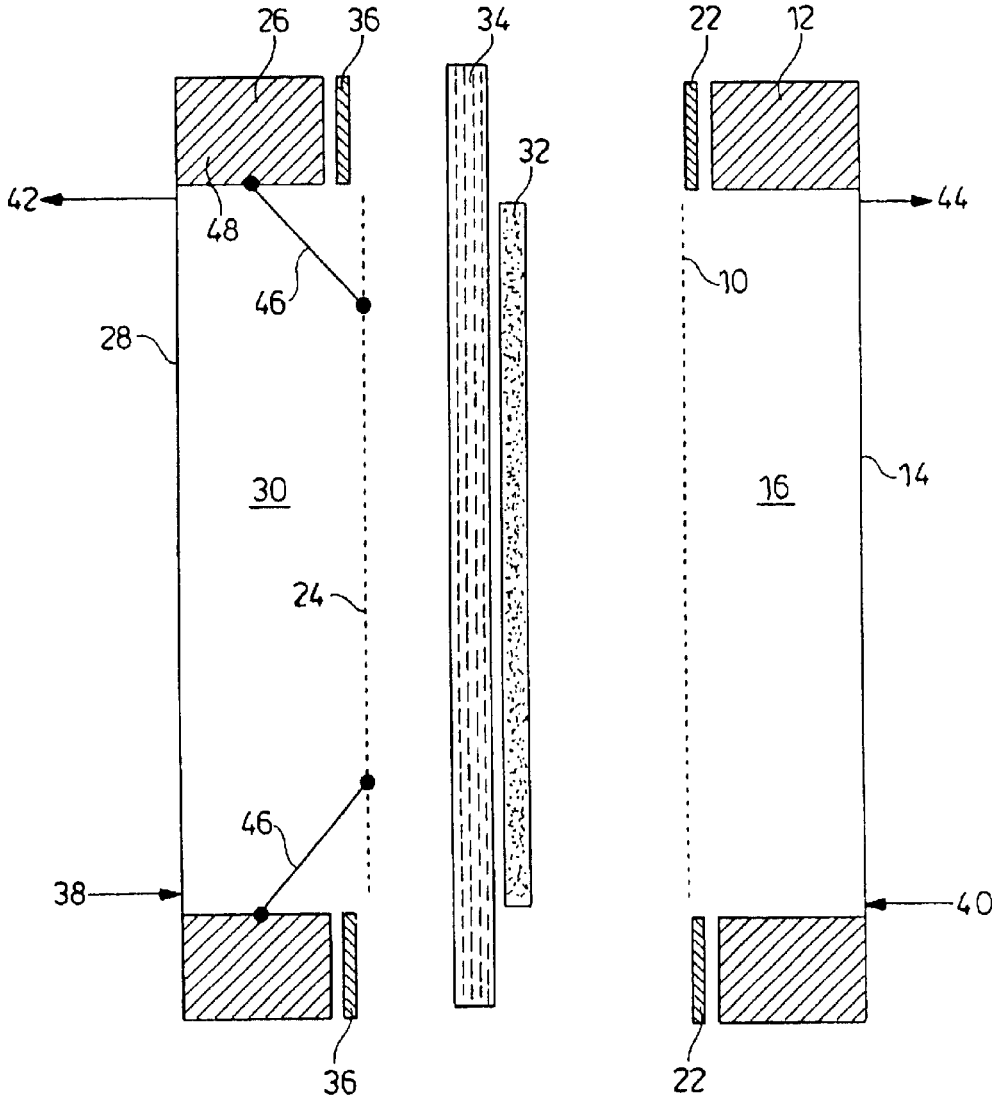

The electrolysis cell of the invention is described in more detail below with the aid of the drawings. In the drawings:

FIG. 1 shows an electrolysis cell according to the invention which has an elastically fastened current collector, FIG. 2 shows an electrolysis cell according to the invention which has an elastically fastened anode, FIG. 3 shows an electrolysis cell according to the invention which has an elastically fastened current collector and an elastically fastened anode and FIG. 4 shows a further embodiment of the electrolysis cell of the invention having an elastically fastened anode.

The electrolysis cells shown schematically in FIGS. 1 to 4 show the individual components of the cell with gaps between them in the interests of clarity. In an assembled electrolysis cell according to the invention, the individual components are in direct contact with one another.

FIG. 1 shows a first embodiment of an electrolysis cell according to the invention. The current collector 10 is elastically fastened to the cathode frame 12. The cathode frame 12 is in turn joined to a back wall 14. The current collector 10, the cathode frame 12 and the back wall 14 form a cathode chamber 16.

In the illustrative embodiment shown, the current collector 10 is held elastically by means of a plurality of helical springs 18. The springs 18 are fastened via connecting pieces 20, e.g. Z-profiles or trapezoidal profiles, to the back wall 14. To transmit a uniform pressure from the springs 18 to the current collector 10, a plurality of regularly distributed springs 18 are provided, depending on the size of the current collector 10. For example, the springs 18 are arranged in a number of horizontal and vertical rows to hold an essentially rectangular current collector 10.

The current collector 10 is surrounded by a seal 22 which in the assembled state is in contact with the cathode frame 12. The shape of the seal 22 corresponds essentially to the shape of the cathode frame 12.

Opposite the current collector 10, there is an anode 24 which is supported by an anode frame 26. To fasten the anode 24 to the frame, the anode 24 can, for example, rest on suitable projections provided on the anode frame 26 or Z-profiles or trapezoidal profiles attached to the back wall 28 (projections/profiles not shown here). In a manner analogous to the cathode chamber 16, the anode frame 26, the anode 24 and a back wall 28 form an anode chamber 30. A gas diffusion electrode 32 and a cation-exchange membrane 34 are located between the anode 24 and the current collector 10. The dimensions of the gas diffusion electrode 32 are preferably such that this fully covers the current collector 10. On the other hand, the cation-exchange membrane 34 is larger so that it is located between the two frames 12, 26 and is held in place by the frames 12, 26 in the assembled state. Furthermore, to ensure that the two frames 12, 26 and the two chambers 16, 30 are securely sealed, a seal 36 is provided between the cation-exchange membrane 34 and the anode frame 26 and a seal 22 is provided between the cation-exchange membrane 34 and the cathode frame 12.

In this embodiment, the gas diffusion electrode 32 is pressed against the cation-exchange membrane 34 by the current collector 10 and the cation-exchange membrane 34 is in turn pressed against the anode 24 when the cell is assembled. It is particularly advantageous for the anode 24 to form a plane with the seal 36 in the installed state.

The construction according to the invention (FIG. 1) enables the pressure in the cathode chamber 16 to be chosen independently of the pressure in the anode chamber 30. In this variant, a higher pressure is preferably selected in the cathode chamber 16 than in the anode chamber 30. The individual elements of the electrolysis cell are sealed by means of the seals 22, 36.

In operation, the anode chamber 30 is filled with hydrochloric acid via an HCl inlet 38 and the cathode chamber 16 is filled with oxygen or an oxygen-containing gas via an $O_2$ inlet 40. The temperature of the hydrochloric acid during the electrolysis is preferably from 50 to 70° C. However, the electrolysis can also be carried out at a lower temperature. During operation of the electrolysis cell, the hydrochloric acid can flow through the anode chamber 30. The chlorine formed leaves the anode chamber 30 via, for example, a $Cl_2$ outlet 42 at the top. It is likewise conceivable for other flow variants to be selected. Thus, for example, flow through the anode chamber 30 can also be from the top downwards. It is likewise conceivable for no forced circulation to be applied externally by means of a pump. The formation of chlorine generates an upwards force (buoyancy) within the anode chamber 30 which can be utilized for pumping purposes (airlift pump principle). In this way, concentration differences within the anode chamber 30 can be avoided by means of the resulting flow in combination with internals, e.g. suitable guide plates or the like.

The oxygen or the oxygen-containing gas can flow through the cathode chamber 16. It is likewise conceivable to influence the flow direction of the oxygen within the cathode chamber 16 by means of internals. Thus, for example, porous materials, either electrically conductive or non-conductive, can be installed in the space behind the current collector 10. The oxygen can, as shown in FIG. 1, be introduced at the bottom via the $O_2$ inlet 40 and be discharged again at the top via an $O_2$ outlet 44. However, it is likewise possible for the oxygen to flow from the top downwards or for the flow in the cathode chamber 16 to have a lateral component, e.g. flow from bottom left to top right. A superstoichiometric amount of oxygen, based on the reaction which occurs, should be supplied.

The anode 24 can be installed in the electrolysis cell so that it projects sufficiently far over the anode frame 26 for it to form a single area with the seal 36 when the latter is placed in position. It is likewise possible for the anode 24 to be located sufficiently far below the seal 36 for the seal 36 to form a plane with the anode 24 in the assembled state of the cell components. Here, the compressibility of the seal 36 and the torques applied during assembly of the cell components have to be taken into account.

If the current collector 10 is, as shown in FIG. 1, connected elastically to the back wall 14, the pressures selected in the anode and cathode chambers can be equal. It is likewise conceivable for the pressure in the cathode chamber 16 to be greater than that in the anode chamber 30. This pressure difference can also be chosen in the event of elevated absolute pressure.

The embodiment shown in FIG. 2 corresponds in principle to the embodiment shown in FIG. 1. Identical or similar components are therefore denoted by the same reference numerals. The only difference compared with the embodiment shown in FIG. 1 is that it is not the current collector 10 but the anode 24 which is joined via the springs 8 and the connecting pieces 20, e.g. Z-profiles or trapezoidal profiles, to the back wall 28. Thus, it is the anode 24 rather than the current collector 10 which is connected elastically to the anode frame 26 via the back wall 28.

In the installed state, the anode 24 is pressed against the cation-exchange membrane 34 by the metallic springs 18, the cation-exchange membrane 34 is pressed against the gas diffusion electrode 32 and the latter is in turn pressed against the current collector 10. The streams of reactants (oxygen and hydrochloric acid) can be conveyed in a similar manner to that in the variant shown in FIG. 1.

If the anode 24 is, as shown in FIG. 2, connected elastically to the anode frame 26 via the back wall 28, the pressure in the cathode chamber 16 can be selected so as to be the same as in the anode chamber 30. However, the pressure in the anode chamber 30 should be at least as high as that in the cathode chamber 16 so that the gas diffusion electrode 32 is in contact with the current collector 10.

The third embodiment (FIG. 3) is a combination of the embodiments shown in FIGS. 1 and 2. In this embodiment, both the anode 24 and the current collector 10 are connected elastically to the back walls 28 and 14, respectively, via springs 18.

In the assembled state, the anode 24 thus presses against the cation-exchange membrane 34 and the current collector 10 on the opposite side presses against the gas diffusion electrode 32, so that in this embodiment it is particularly reliably ensured that these components of the electrolysis cell are in contact with one another without any gaps. The oxygen and hydrochloric acid can flow through the cell in similar ways to those described for the embodiments shown in FIGS. 1 and 2.

If, as shown in FIG. 3, both the current collector 10 and also the anode 24 are connected elastically, the electrolysis cell can be operated in a wide pressure range with direct contact between the gas diffusion electrode 32 and the current collector 10 being ensured.

The fourth embodiment (FIG. 4) likewise corresponds in principle to the electrolysis cell described in FIGS. 1 to 3. Identical or similar components are therefore once again denoted by the same reference numerals. The significant difference between the electrolysis cell shown in FIG. 4 and those shown in the other figures is in the type of holding elements 46 employed. The holding elements 46 are not helical springs 18 as in the embodiments shown in FIGS. 1 to 3 but a type of leaf spring which is fastened to an inside 48 of the anode frame 26 and the anode 24. The holding element 46 likewise applies a force to the anode 24 in the direction of the current collector 10, so that in this embodiment, too, there is no gap between current collector 10, gas diffusion electrode 32, cation-exchange membrane 34 and anode 24. Like the springs 18 (FIGS. 1–3), the holding elements 46 can also serve as electrical contacts.

Furthermore, it is possible to fasten the current collector 10 to the cathode frame 12 by means of corresponding holding elements 46, either in addition to or in place of the fastening of the anode 24 by means of such holding elements.

The possible pressure differences and reactant flows as described above can be achieved by holding of the anode 24 and/or the current collector 10 by means of an appropriate arrangement of the holding elements 46.

A process which can be carried out using the apparatus of the invention is illustrated in the following examples. However, the examples do not imply any restriction of the scope of the invention.

EXAMPLE 1

An electrolysis of an aqueous solution of hydrogen chloride was carried out in an electrolysis cell as shown schematically in FIG. 1 and described in greater detail above.

The anode 24 was installed in the electrolysis cell so that it projected over the anode frame 26 sufficiently far for it to form a single area with the seal 36 when the latter had been put in place. The anode 24, the anode frame 26, the current collector 10, the cathode frame 12 and the electrically conductive springs 18 were made of a titanium-palladium alloy containing 0.2% by weight of palladium. The anode 24 was in the form of expanded metal and was additionally activated with a ruthenium oxide layer. The thickness of the expanded metal was 1.5 mm. The seals 36 were composed of a fluorinated elastomer as is sold by DuPont under the trade name Viton®. The current collector 10 was likewise in the form of titanium expanded metal coated with ruthenium oxide. Electrical contact between the current collector 10 and the elastic springs 18 was established by means of point welding. As gas diffusion electrode 32, use was made of a gas diffusion electrode from E-TEK, USA, which was based on carbon with a platinum catalyst. The cation-exchange membrane 34 was a membrane from DuPont which is based on a perfluorosulphonate polymer and is commercially available under the trade name Nafion® 324. The cation-exchange membrane 34 divided the electrolysis cell into an anode chamber and a cathode chamber.

The anode chamber was supplied with a 14% strength by weight hydrochloric acid. The temperature of the hydrochloric acid was 53° C. The cathode chamber was supplied with pure oxygen having an oxygen content of more than 99% by volume. The pressure in the cathode chamber was 1 bar. The differential pressure between cathode chamber and anode chamber was 0 bar. The electrolysis was carried out at a current density of 3 000 A/m$^2$, with a voltage of 1.05 V being established.

EXAMPLE 2

COMPARATIVE EXAMPLE

An electrolysis of an aqueous solution of hydrogen chloride was carried out in an electrolysis cell as described in Example 1, but in this case the current collector 10 was not connected elastically to the cathode frame 12.

The anode chamber was supplied with a 14% strength by weight hydrochloric acid. The temperature of the hydrochloric acid was 53° C. The cathode chamber was supplied with pure oxygen having an oxygen content of more than 99% by volume. The pressure in the cathode chamber was 1 bar. The differential pressure between cathode chamber and anode chamber was 0.3 bar, so that the pressure in the anode chamber was 1.3 bar. The application of a differential pressure was, in contrast to the procedure of Example 1, necessary to press the gas diffusion electrode 32 against the current collector 10. The electrolysis was carried out at a current density of 3 000 A/m$^2$ as in Example 1. A voltage of 1.21 V was established under these conditions.

Comparison of Examples 1 and 2 shows that, at a given pressure in the cathode chamber and a constant current density, the electrolysis cell of the invention (Example 1) can be operated at a lower pressure in the anode chamber and the voltage is lower, which leads to a significant reduction in the energy consumption.

What is claimed is:

1. An electrolysis useful for the electrochemical preparation of chlorine from aqueous solutions of hydrogen chloride comprising (a) an anode frame supporting (b) an anode, (c) a cathode frame supporting (d) a current collector, (e) a cation-exchange membrane located between the anode and the current collector and (f) a gas diffusion electrode located between the cation-exchange membrane and the current collector, characterized in that the anode is elastically connected to the anode frame and/or the current collector is elastically connected to the cathode frame in a manner such that (b), (e), (f) and (d) are held together so that no gap or intermediate space occurs between them during operation of the electrolysis cell.

2. Electrolysis cell according to claim 1, characterized in that an elastic holding element is provided between the anode and the anode frame and/or between the current collector and the cathode frame.

3. Electrolysis cell according to claim 2, characterized in that a plurality of holding elements are provided.

4. Electrolysis cell according to claim 2 or 3, characterized in that the holding element or the holding elements are arranged and/or configured so that the anode and/or the current collector exerts an essentially uniform pressure.

5. Electrolysis cell according to any of claims 2 to 4, characterized in that the holding element or elements are configured as spring elements.

6. Electrolysis cell according to any of claims 2 to 5, characterized in that electrical contact to the anode and/or to the current collector is established by means of the holding elements.

7. Electrolysis cell according to any of claims 2 to 6, characterized in that the anode frame and/or the cathode frame has/have a back wall to which the holding element or elements is/are connected.

8. Electrolysis cell according to any of claims 2 to 7, characterized in that the anode and/or the current collector is/are held solely by the elastic holding element or elements.

* * * * *